US006817427B2

(12) United States Patent
Matsuo et al.

(10) Patent No.: US 6,817,427 B2
(45) Date of Patent: Nov. 16, 2004

(54) DEVICE AND METHOD FOR EXTRACTING A GAS HYDRATE

(75) Inventors: Katsuya Matsuo, Tokyo (JP); Sosuke Kurosaka, Tokyo (JP); Yutaka Yanagimori, Tokyo (JP); Shuntaro Asano, Tokyo (JP); Junji Shinoda, Tokyo (JP)

(73) Assignees: Tobishima Corporation, Tokyo (JP); Fuji Research Institute Corporation, Tokyo (JP)

( * ) Notice: Subject to any disclaimer, the term of this patent is extended or adjusted under 35 U.S.C. 154(b) by 0 days.

(21) Appl. No.: 10/242,506

(22) Filed: Sep. 13, 2002

(65) Prior Publication Data

US 2003/0136585 A1 Jul. 24, 2003

(30) Foreign Application Priority Data

Jan. 18, 2002 (JP) ..... 2002-010757

(51) Int. Cl.[7] ..... E21B 7/18

(52) U.S. Cl. ..... 175/67; 175/69; 166/263; 166/371; 299/17

(58) Field of Search ..... 175/65, 67, 69; 166/263, 369, 265, 371, 308.1; 299/7, 9, 17

(56) References Cited

U.S. PATENT DOCUMENTS

| | | | | | |
|---|---|---|---|---|---|
| 4,376,462 | A | * | 3/1983 | Elliott et al. | 166/265 |
| 4,424,866 | A | * | 1/1984 | McGuire | 166/371 |
| 4,640,355 | A | * | 2/1987 | Hong et al. | 166/269 |
| 5,253,718 | A | * | 10/1993 | Lawler | 175/67 |
| 6,024,171 | A | * | 2/2000 | Montgomery et al. | 175/67 |

FOREIGN PATENT DOCUMENTS

| | | |
|---|---|---|
| JP | H6-71161 | 3/1994 |
| JP | H9-158662 | 6/1997 |
| JP | H10-317869 | 12/1998 |

* cited by examiner

*Primary Examiner*—David Bagnell
*Assistant Examiner*—Matthew J. Smith
(74) *Attorney, Agent, or Firm*—Lowe Hauptman Gilman & Berner, LLP

(57) ABSTRACT

This invention aims to provide a gas-hydrate extracting device and method whereby a high-performance jet fluid is injected from a nozzle at the tip of an extraction pipe inserted into a gas-hydrate stratum, and whereby said jet fluid breaks said stratum so as to form a gas-hydrate mixed fluid that is transferred to surface of the earth, and whereby the void resulting from the removal of said gas hydrate is filled with the components of said high-performance jet fluid and a void-refilling fluid.

13 Claims, 4 Drawing Sheets

An enlarged view of the part A in Fig. 1(a)

Another embodiment of extraction of the gas-hydrate (bent boring)

An operation procedure of gas hydrate extraction

Fig. 4(a)

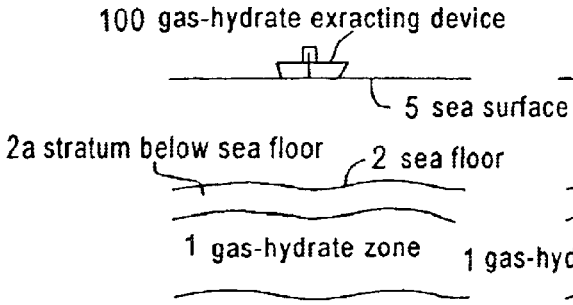

a placing and preparing step

Fig. 4(b)

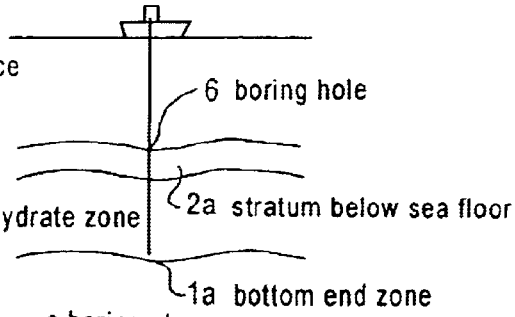

a boring step

Fig. 4(c)

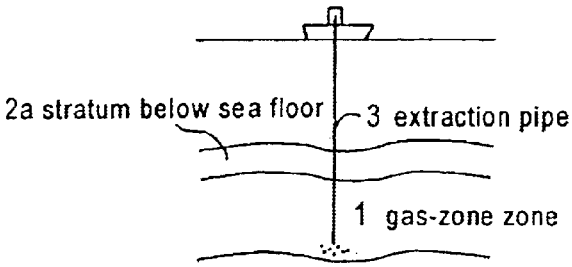

a step for starting injection and agitation, and extraction and refilling of the gas

Fig. 4(d)

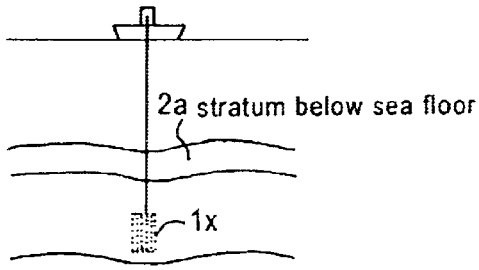

a step for retracting the extraction pipe during injection/agitation, refilling, and extraction and replacement of the gas

Fig. 4(e)

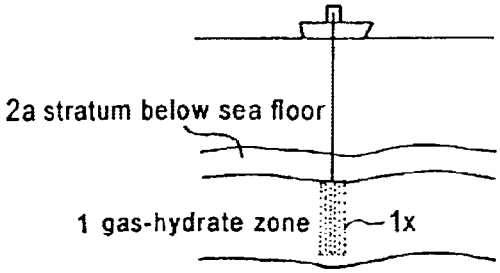

a step for finishing the injection and agitation and completing replacement

Fig. 4(f)

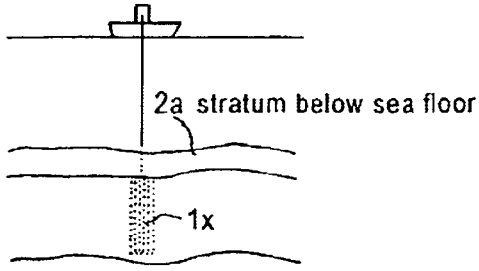

an extraction pipe removal step

DEVICE AND METHOD FOR EXTRACTING A GAS HYDRATE

TECHNICAL FIELD OF THE INVENTION

The present invention relates to a method for extracting fossil fuels, and more particularly to a method for recovering gas from a gas hydrate deposited in a formation underground or under the sea floor, and for preventing the collapse of the formation from which the gas hydrate has been extracted.

BACKGROUND OF THE INVENTION

Methane hydrate is deposited in underground sedimentary layers near the pole regions, hundreds to thousands meters below sea level, as a crystalline structure of methane entrapped or engaged in an expanded lattice of water, and it is regarded as a valuable resource. In order to recover the methane gas from a methane hydrate, it is necessary to change the temperature, the pressure and the balance of salt concentration of the hydrate material.

Several methods have been proposed.

(1) Heat-stimulation method (Hot water or a hot vapor is pumped into a hydrate, which it gasifies.)

(2) Depressurization method (The pressure of the gas in a hydrate is reduced.)

(3) Salt-concentration method (Salt water is pumped into a hydrate so as to promote the gasification thereof.)

(4) Chemical-injection method (Decomposition promoters such as methanol or glycol are injected into a hydrate so as to promote its gasification.)

(5) $CO_2$-gas (or liquid $CO_2$) replacing method (Carbon dioxide gas, which is more easily hydrated than methane is, is injected into a hydrate so as to replace the methane.)

Or, a combination of the above methods can be used.

Japanese Unexamined Patent Application No. H10-317869 proposed a high-pressure vapor-injection method (1) as mentioned above, which consists of constructing a gas-shielding wall around the hydrate stratum and then injecting high-temperature vapor to promote the decomposition of the hydrate. Japanese Unexamined Patent Application No. H9-158662 proposed the construction of a nuclear reactor at the floor of a deep sea so as to create a flow of warm surface seawater to the methane-hydrate stratum. However, because a void is produced in the sea floor stratum after the methane gas has been extracted, it is feared that the above-mentioned methods (1)–(4) can cause some deformation or collapse of the sea floor, which is fragile.

Also, in Japanese Unexamined Patent Application No. H6-71161, a carbon-dioxide-gas replacing method has been proposed. In this method, the stratum is replaced with a carbon-dioxide hydrate. However, because the $CO_2$ gas is more easily hydrated than methane is, the injected $CO_2$ gas is sometimes stabilized before the replacement. Therefore, $CO_2$ gas, although favorable for the purpose of such stabilization, is economically unfavorable for the production of methane gas.

The conventional pressure-reduction method (2) also has a problem in that the possibility of continuous recovery of gas cannot be assured because it greatly depends upon the pressure of free gas, and the conventional chemical-injection method (4) has a problem in that the usage of chemicals is not economical. Furthermore, according to a survey relating to methane-hydrate strata at the sea floor, the stratum containing methane hydrate is sometimes unstable, and changes such as collapse and decomposition have occurred repeatedly in the past. From the global point of view, it is necessary on a worldwide level to prevent the dangers of troubles (geohazards) associated with landslides, large-scale sinking or rising of the sea floor, and leakage of natural gases.

The present invention has been made in view of the above-mentioned problems, and one object thereof is to provide a method of extracting a gas hydrate, whereby a gas hydrate is directly transferred to surface of the earth and the gas is recovered efficiently by controlling the decomposition of the gas, and whereby the void that results after the removal of said gas hydrate is properly filled.

Another object of the present invention is to provide an economical and safe method of extracting a gas hydrate by filling the void with industrial by-products from such industrial fields as steelmaking, power generation, and ceramic making. Another object of the present invention is to provide a method for preventing the gas-hydrate stratum from collapsing after the gas hydrate has been removed therefrom, which might cause a geohazard.

BRIEF SUMMARY OF THE INVENTION

For the purpose of solving the aforementioned problems, the present invention's method of extracting a gas hydrate is characterized such that a high-performance jet fluid is injected from a nozzle at the tip of an extraction pipe that has been inserted into a gas-hydrate stratum, and said jet fluid breaks the gas-stratum so as to form a gas-hydrate mixed fluid that is recovered on the surface of the earth, and the void that results from the removal of the gas hydrate is filled with the components of said high-performance jet fluid and a void-refilling fluid According to the present invention, the gas hydrate, which is iced or solidified in a gas-hydrate stratum under high pressure and low temperature, is broken and is moved to the surface of the earth as a gas-hydrate mixed fluid. Therefore, the gas hydrate can be efficiently extracted from the stratum. In addition, the void resulting from the removal of the gas hydrate is filled so as to prevent the deformation of the ground after the extraction. Therefore, the extraction can be carried out safely. The gas hydrate is also safely recovered from the gas-hydrate stratum, and future geohazards, such as ground subsidence, landslides, or sinking or rising of the sea bottom, can be prevented by filling the aforementioned void.

Furthermore, a high-performance jet fluid is used for breaking the gas-hydrate stratum, so that extraction can be performed without loss of power or failure of the mechanism involved, even deeply underground or far below the surface of the sea. Also, extraction can be safely performed without adversely affecting the surrounding ground.

The extraction pipe is inserted near the bottom of the gas-hydrate stratum and is slowly retracted upwardly while rotating.

According to the present invention, the upward retraction of the injection nozzle while it is rotating can break the gas hydrate over a wide area of the stratum. Therefore, a large volume of a gas-hydrate zone can be excavated with a single well (one excavation hole), resulting in improvement of efficiency. If the extraction pipe is inserted further in the horizontal direction at the deep end (bent boring), an even wider area can be covered.

The void resulting from the removal of the gas hydrate can be filled or replaced with components of the high-performance jet fluid and the void-refilling fluid. The components are cement, chemicals, and carbon dioxide gas ($CO_2$). The stratum can be stabilized by this method.

In addition, the gas-hydrate mixed fluid is transferred to surface of the earth as controlled by the injection pressure of the high-performance jet fluid, the speed of rotation of the injection nozzle, and the speed of retraction of the extraction pipe.

According to the present invention, the breaking or drilling volume of the gas-hydrate zone can be controlled by the rate of flow of the gas-hydrate mixed fluid, which in turn depends on the injection pressure of the high-performance jet fluid, the speed of rotation of the injection nozzle, and the speed of retraction of the extraction pipe.

The gas-hydrate mixed fluid is composed of three phases of air, including gases separated at the gas hydrate zone, water, and the solids derived from the stratum structure, and the solids are used as the components of the high-performance jet fluid and/or the void-refilling fluid.

According to the present invention, the area of the gas-hydrate zone that is broken can be controlled. Furthermore, the temperature of the high-performance jet fluid is higher than that of the gas hydrate, which serves to partially separate the gas and causes an upward flow of the gas, which is helpful in minimizing energy consumption. Sediments derived from the stratum structure in the gas-hydrate zone are separated and can be used as the components of the high-performance jet fluid and/or the void-refilling fluid.

The high-performance jet fluid is composed of air and slurry containing fine solids selected from sand and clay.

According to the present invention, the components of the high-performance jet fluid used for breaking the gas-hydrate zone can be commonly used as the void-refilling fluid that is used to fill the void in the gas-hydrate zone. Air is injected along with the high-performance jet fluid to raise the efficiency of breaking the gas-hydrate stratum.

The aforementioned fine solids are further selected from blast-furnace slag, coal ash, and killer.

According to the present invention, the use of industrial by-products can lower the cost of the void-refilling fluid and, at the same time, such use provides a means for safely disposing of industrial by-products.

Preferably the aforementioned fine solids contain at least one selected from blast-furnace slag, coal ash, and cement.

According to the present invention, the void resulting from the extraction can be filled and solidified by the use of hardening materials such as cement, blast-furnace slag, coal ash, or killer. This can prevent future landslides and ground subsidence.

The extraction pipe is a multiple-pipe structure that is composed of (a) a high-pressure pipe by which the high-performance jet fluid is conveyed to the injection nozzle at the tip, (b) a high-performance fluid duct by which the high-performance jet fluid is conveyed to the injection nozzle at the tip, and (c) a fluid-recovery pipe by which the gas-hydrate mixed fluid is transferred to surface of the earth.

According to the present invention, the multiple pipe structure can drill the gas-hydrate zone and transfer the gas-hydrate mixed fluid to the surface of the earth with one boring hole. Therefore, this is applicable to a gas-hydrate zone even under a deep-sea floor.

The water of said super high-pressure slurry is river water and spring water from the surface of the earth or seawater from near the surface of the sea.

According to the present invention, rich resources such as river water, spring water, or seawater can be favorably used, because the large temperature difference between the water and the gas-hydrate zone serves as a heat source for gas decomposition. Gas separation is further promoted by raising the temperature of the water by using sunlight or a heat source.

The extraction pipe has a control mechanism to control the pressure and speed at which said gas-hydrate mixed fluid is transferred to the surface of the earth.

According to the present invention, accidents, such as blast jet, that result from rapid gas decomposition can be prevented by controlling the pressure difference between the gas-hydrate zone and that at the surface of the earth.

The present invention's device for extracting a gas hydrate comprises:

an extraction pipe that is composed of (a) a high-pressure pipe by which the high-performance jet fluid is conveyed to the injection nozzle at the tip, (b) a high-performance fluid duct by which the void-refilling fluid is conveyed to the injection nozzle at the tip, and (c) a fluid-recovery pipe by which the gas-hydrate mixed fluid is transferred to surface of the earth;

an extraction-pipe control unit that controls the speed of rotation and the speed of retraction of said extraction pipe;

an extracting-fluid supply unit that supplies a high-pressure fluid, a void-refilling fluid, and high-pressure air;

a pressure-control unit of the extraction pipe;

a gas-extracting device by which gases are recovered from the gas-hydrate mixed fluid;

Said device is inserted into a boring hole that has been drilled to a gas-hydrate stratum;

With the gas-hydrate extracting device of the present invention, the aforementioned gas-hydrate extracting method can be realized.

A high-performance jet fluid is injected so as to break the gas-hydrate stratum, and a void-refilling fluid is injected to fill the stratum so as to compensate for the volume of gas hydrate that has been removed.

According to the present invention, a nozzle of the high-performance jet fluid for breaking the gas-hydrate stratum and a nozzle of the void-refilling fluid are separately provided, so that both breaking and filling can be controlled. This method is realized by the multiple-pipe structure that enables a he high-performance fluid duct to be inserted into the fluid-recovery pipe.

The gas hydrate is an ice-like substance including at least methane or butane, and said gas-hydrate stratum is a zone in which said gas hydrate is buried in a state of dispersion, mass, layer, or cluster under the ground or under the sea floor.

The process of the present invention can be widely applied to the extraction of any gas hydrate other than a conventional natural-gas hydrate. Furthermore, the void of the gas-hydrate stratum that results from extraction can be filled and stabilized in both land and sea areas where troubles (geohazards) might result due to removal of the gas hydrate. Therefore, troubles (geohazards) due to deformation of the ground can be limited.

BRIEF DESCRIPTION OF THE DRAWINGS

The present invention is illustrated by way of example, and not by limitation, in the figures of the accompanying drawings, wherein elements having the same reference numeral designations represent like elements throughout and wherein:

FIG. 1(*b*) shows the structure of the tip end of an extracting pipe 30;

FIG. 4A is a schematic diagram illustrating a placing and preparing step;

FIG. 4B is a schematic diagram illustrating a boring step;

FIG. 4C is a schematic diagram illustrating a step for starting injection and agitation and extraction and refilling of the gas;

FIG. 4D is a schematic diagram illustrating a step for the extraction pipe during injection/agitation, refilling and extraction and replacement of the gas;

FIG. 4E is a schematic diagram illustrating a step for finishing the injection and agitation and completing replacement; and FIG. 4F is a schematic diagram illustrating an extraction pipe removal step.

Figure 1A:
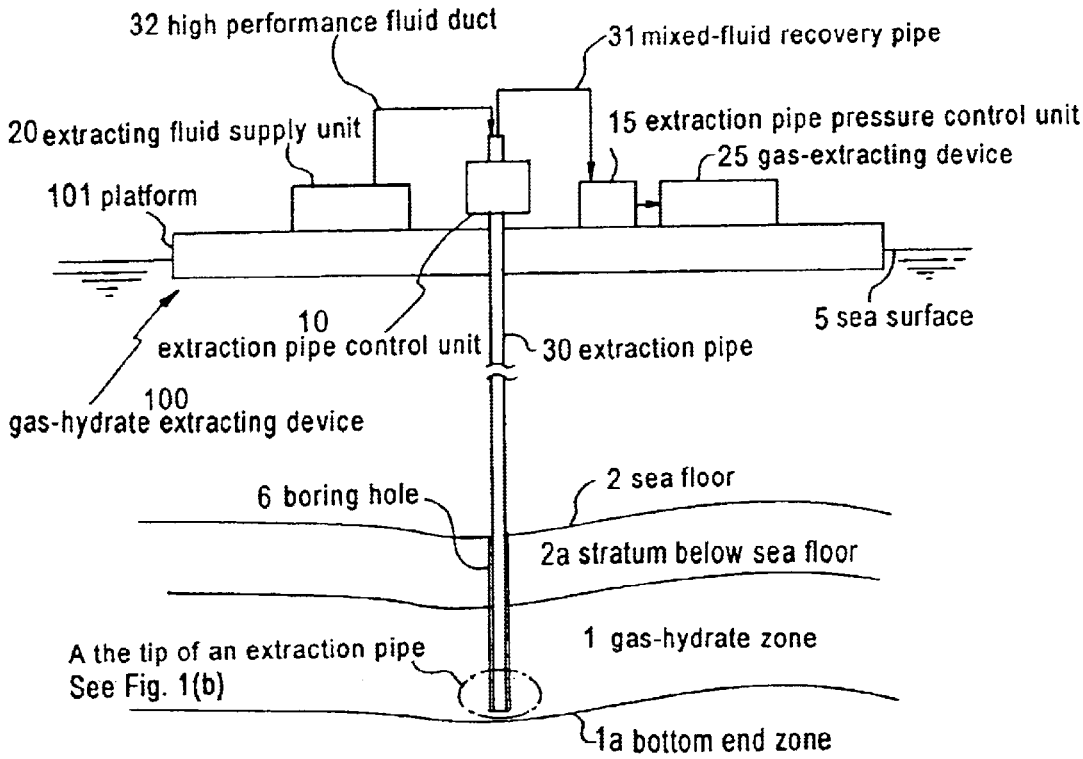
FIG. 1(*a*) shows the structure of a gas-hydrate extracting device 100 of the present invention.

The gas-hydrate extracting device 100 comprises a platform 101 arranged on the sea surface 5 and an extraction pipe 30 inserted into a boring hole 6 drilled near the bottom 1*a* of the gas-hydrate stratum 1 through the sea-floor stratum 2*a* of the sea floor 2. Also, in this embodiment, the extraction of the gas hydrate from under the sea floor is shown as an example, but in the case of extraction under land, the facilities on land function similarly as mentioned above.

Said device further comprises (a) an extraction-pipe control unit 10 for regulating the rotation and retraction speeds of the extraction pipe 30, (b) an extraction-fluid supply unit 20 for supplying high-pressure fluids containing a void-refilling fluid 21 and high-pressure air, (c) an extraction-pipe pressure-control unit 15 that controls the pressure of said extraction pipe 30, and (d) a gas-extracting device 25 for recovering gas from the gas-hydrate mixed fluid 4, which contains some sediments from the gas-hydrate-stratum structure.

Figure 1B:
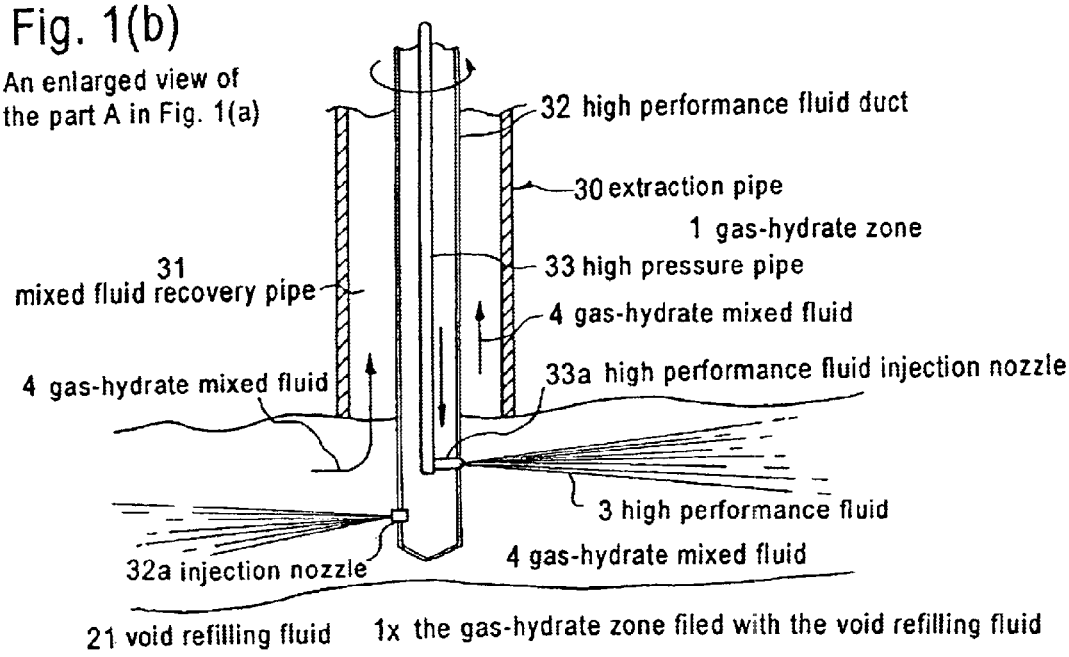

As shown in FIG. 1(*b*), said extraction pipe 30 has a triple structure, wherein are arranged (a) a fluid-recovery pipe 31, (b) a high-pressure pipe 33 having an injection nozzle 33*a* for the high-performance jet fluid 3, and (c) a high-performance fluid duct 32 having an injection nozzle 32*a* for the void-refilling fluid 21.

The illustrated embodiment shows a condition such that a high-pressure pipe 33 is inserted into a high-performance fluid duct 32, but the fluid duct 32 can be inserted into the high-pressure pipe 33. Also, the high-pressure pipe 33 can have a structure such that the slurry and the high-pressure air are conveyed separately and are joined at the injection nozzle 33*a* (not shown). The structure of the extraction pipe 30 is not limited to this embodiment, but should be selected according to the conditions of the extracting site.

The high-performance fluid duct 32 injects, by rotating, the high-performance jet fluid 3 and the void-refilling fluid 21 into the surrounding gas-hydrate stratum 1, so as to break up that stratum. The resulting gas-hydrate mixed fluid 4 is transferred through the fluid-recovery pipe 31. At that time, the high-performance jet fluid 3 and the void-refilling fluid 21 are inserted into the stratum so as to compensate for the volume of gas hydrate that has been removed.

The extraction-pipe control unit 10 controls the extraction pipe 30 so as to insert it near the bottom of the gas-hydrate stratum and to retract it back to the surface of the earth while rotating the injection nozzles 32*a*, 33*a* at the tip of the extraction pipe 30 and while injecting the high-performance jet fluid 3 and the void-refilling fluid 21 into the stratum surrounding the gas hydrate. At this time, the gas-hydrate mixed fluid 4 is transferred to the surface of the earth, and the void resulting from the removal of the gas hydrate is filled with the solid components of the high-performance jet fluid 3 and the void-refilling fluid 21.

The extraction pipe 30 can drill through the sea floor and be inserted into the gas-hydrate zone 1 using a drilling device (such as a boring bit) at the tip of the extraction pipe 30.

At this time, the extracting-fluid supply unit 20 controls the breaking area in the gas-hydrate zone 1 by adjusting the injection pressure of the high-performance jet fluid 3 and the void-refilling fluid 21. The extraction-pipe control unit 10, by adjusting the speed of rotation of the high-performance fluid duct 32 and the speed of retraction of the extraction pipe 30, controls the speed at which the gas-hydrate mixed fluid 4 is extracted.

At the top of said mixed-fluid-recovery pipe 31 is an extraction-pipe pressure-control unit 15, which is a pressure-control mechanism that controls the pressure of the fluid-recovery pipe 31 so that the pressure of the gas-contained mixture fluid 4 to be transferred to the surface of the earth is controlled so that the gasification of the cut and broken gas hydrate is controlled and the recovery speed of the gas-contained mixture fluid 4 containing stratum slime also is controlled.

The gas-extracting device 25 separates and recovers gas from the gas-hydrate mixed fluid 4. The gas-hydrate mixed fluid 4 that is transferred to surface of the earth or to a sea platform is composed of three phases of air including the gas separated from the gas-hydrate stratum, water, and solids from the stratum structure.

The gas-extracting device 25 supplies to the extracting-fluid supply unit 20 the solid residue that remains after gas separation and that is to be used as a component of the high-performance jet fluid 3 and/or the void-refilling fluid 21.

Figure 3:
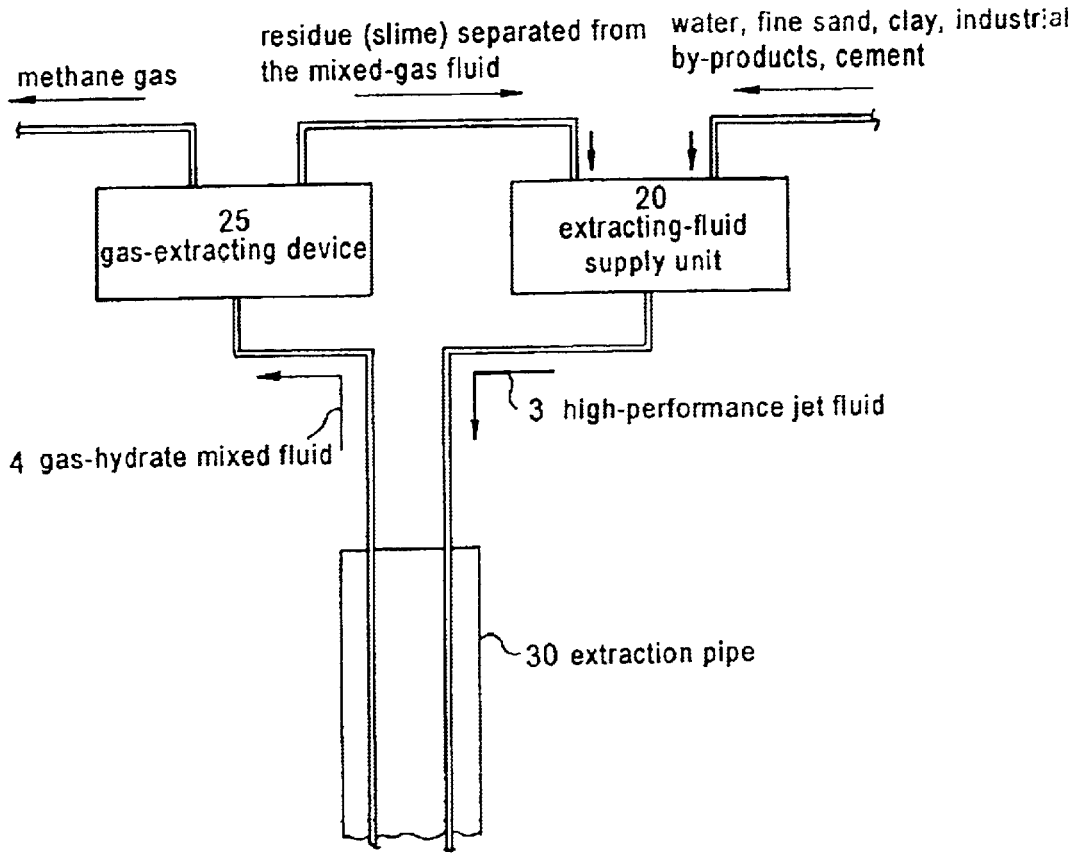
FIG. 3 is a schematic diagram illustrating a scheme for reusing the recovered gas-hydrate mixed fluid.

FIG. 3 is a schematic diagram illustrating the scheme for reusing the recovered gas-hydrate mixed fluid. The gas-extracting device 25 separates gas and solid residues from the gas-hydrate mixed fluid 4, conveys the separated gas to gas-storage/transportation units (not shown), and conveys the solid residue to the extracting-fluid supply unit 20.

In the extracting-fluid supply unit 20, solids selected from fine sand, clay, and fine granular materials including industrial by-products such as cement, blast-furnace slag, and coal ash, are incorporated in both the high-performance jet fluid and the void-refilling fluid. The use of industrial by-products can lower the cost of the fluids and achieve safe disposal of such by-products without causing any pollution.

If a sea platform is used, seawater near the surface of the sea is preferably used, because, due to the high temperature of the seawater and due to its nature as saltwater, the heat balance and the salt-concentration balance of the gas hydrate can be made to vary so as to promote gas separation. When further gas separation is required, the water temperature should be raised by a heat source, which could be sunlight. Where on-land facilities are used, usually river water or spring water is used.

Figure 2:
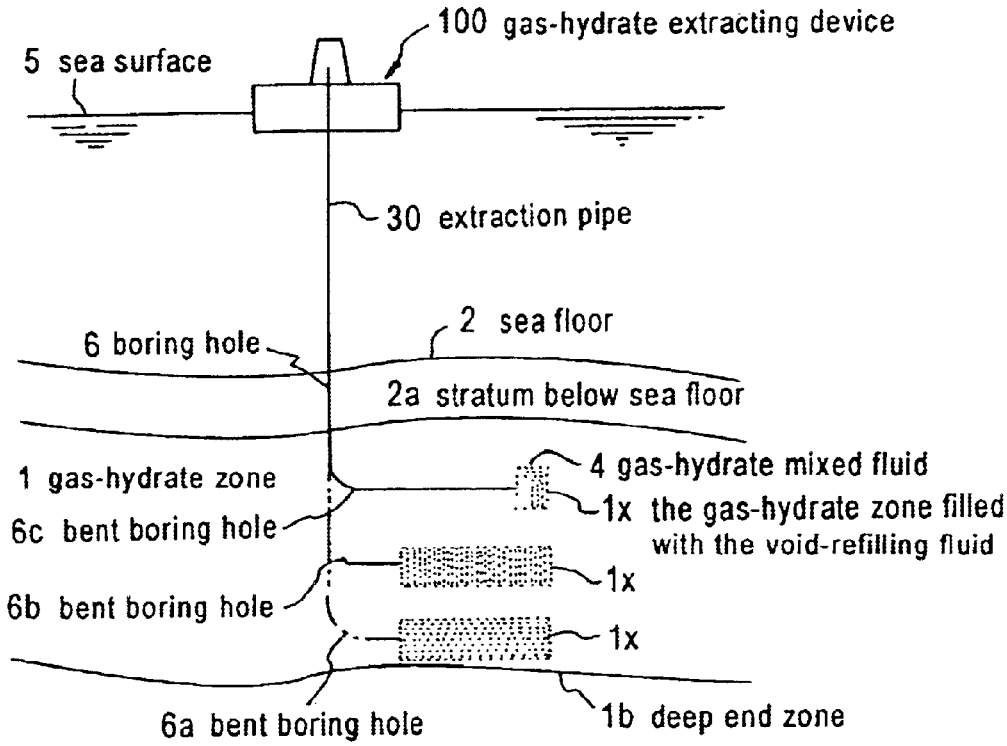
FIG. 2 is a schematic diagram of the gas-hydrate extraction process in another embodiment (bent boring)

FIG. 2 shows a schematic diagram in another embodiment (bent boring) of gas-hydrate extraction.

In this embodiment, the boring is performed horizontally in the gas-hydrate stratum 1 as a bent boring hole 6*a*. The extraction pipe 30 is inserted into the deep end 1*b* of the stratum. Then, a bent boring hole 6*b*is similarly drilled into the gas-hydrate zone 1, and a bent boring hole 6*c* is drilled into the gas-hydrate zone 1 as well. In this embodiment, even with a single well (one drilling hole), gas-hydrate can be extracted from a wider area of the gas-hydrate zone. This method improves extraction efficiency.

Because gas hydrates exist in natural environments that are in a state of delicate balance, there is always the danger that a collapse or deformation of the ground will occur due to some external factor such as an earthquake or that leakage of gas will result due to a landslide or sinking or rising of the ground. The present invention can be applied to a method for recovering gas from the gas hydrate located in an unstable land or sea area, and for stabilizing the stratum after the gas is extracted.

FIGS. 4A–4F is a schematic diagram illustrating an operation of gas-hydrate extraction. As illustrated in FIG. 4A, the placing and preparing step (1) a platform (of a drilling ship) equipped with a gas-hydrate extracting device moves over the sea surface 5 in the area where the gas-hydrate stratum is located under the sea floor.

As illustrated in FIG. 4B, in boring step (2), a boring hole 6 is drilled such that it penetrates through the sea-bottom stratum 2*a* and reaches the bottom-end layer 1*a* of the gas hydrate layer 1.

As illustrated in FIG. 4C, in the gas extraction/replacement start step (3), an extraction pipe 30 is inserted into the boring hole 6, and the high-performance fluid duct 32 is rotated so as to inject the high-performance jet fluid 3, so that the surrounding gas-hydrate stratum 1 is broken.

As illustrated in FIG. 4D. in the extraction-pipe retraction step (4), the extraction pipe 30 is retracted, injecting the high-performance jet fluid 3 and the void-refilling fluid 21 so as to break the surrounding gas-hydrate stratum 1 and to fill the resulting void with the fluids. The retraction of the extraction pipe 30 makes the extraction area wider towards the top of the stratum of the gas hydrate layer 1.

As illustrated in FIG. 4E. in the replacement-completion step (5), the injection is stopped when the retraction of the injection point reaches the top of the gas-hydrate stratum 1.

As illustrated in FIG. 4F. in the extraction-pipe removal step (6), the extraction pipe 30 is completely retracted to the surface of the earth and is moved to the next drilling site.

As to the gas-hydrate extracting device 100 in this example, one extraction pipe 30 and one extraction-pipe control unit 10 are used, but plural extraction pipes 30 can be simultaneously controlled from the platform 101.

The injection pressure is typically 150 Mpa or more for the extraction of the gas hydrate at a distance of as far as 8 meters around the extraction pipe 30, though the pressure should be decided upon based on the conditions of the gas hydrate and the depth of the stratum, If the gas-hydrate zone 1 is composed 20% of methane hydrate, and if the methane hydrate is composed 80% of methane, the volume of the methane hydrate becomes 216 times greater when the gas-hydrate is gasified. One cubic meter of the gas hydrate produces 35 cubic meters of methane. When extraction is performed at a retraction speed of 10 m/hour, 400,000 cubic meters of methane gas can be extracted in one day The device and method for extracting gas hydrate of the present invention provide the following benefits.

According to the present invention, a gas hydrate, which is iced or solidified in a gas-hydrate stratum under high pressure and low temperature, is broken and then transferred to surface of the earth as a gas-hydrate mixed fluid. Therefore, a gas hydrate can be efficiently extracted from the stratum. In addition, the void resulting in the stratum due to the removal of the gas hydrate is filled so as to prevent the deformation of the ground after the extraction. Therefore, the extraction can be carried out safely.

Furthermore, a high-performance jet fluid is used for breaking the gas-hydrate stratum, so that extraction can be performed with little loss of power and without failure of the mechanism used, even deeply underground or under the ground beneath the sea. Also, extraction can be safely performed without adversely affecting the surrounding ground.

According to the present invention, the retraction of the injection nozzle while it is being rotated can cover a wide area of the stratum so as to break the gas hydrate. Therefore, a large volume of a gas-hydrate zone can be excavated with a single well (one excavation hole), resulting in improved extraction efficiency. If the extraction pipe is inserted further in the horizontal direction at the deep end (bent boring), an even wider area of the gas-hydrate zone can be covered. The void resulting from the removal of the gas hydrate can be filled or replaced with slurry composed of the components of the high-performance jet fluid and a void-refilling fluid. The components are cement, chemicals, and carbon dioxide gas ($CO_2$). The stratum can be stabilized by this method.

According to the present invention, the breaking area and the drilling volume of the gas-hydrate layer can be controlled. Furthermore, the high-performance jet fluid, which has a higher temperature than the gas hydrate, partially separates the gases of the gas-hydrate layer and forms an upward flow with the gas, which minimizes energy consumption. Sediments derived from the stratum structure of the gas-hydrate zone are separated and can be used as the component of the high-performance jet fluid and/or the void-refilling fluid use to fill the void that results from the extraction.

According to the present invention, the composition of the high-performance jet fluid used for breaking the gas-hydrate zone can be used as a void-refilling fluid to fill the void resulting from the extraction. Air is injected along with the high-performance jet fluid so as to raise the efficiency of breaking the gas-hydrate stratum. The use of industrial by-products can lower the cost of the void-refilling fluid and, at the same time, can provide a means for safely disposing of those industrial by-products. The refilled void can be solidified by the use of hardening materials such as cement, blast-furnace slag, coal ash, and killer. Such solidification can prevent landslides.

According to the present invention, a multiple-pipe structure can be used to drill the gas-hydrate zone and to transfer the gas-hydrate mixed fluid to the surface of the earth with only one boring hole. Therefore, a gas hydrate can be efficiently extracted even from a gas-hydrate zone that is under a deep-sea floor.

According to the present invention, rich resources such as river water, spring water, or seawater can be favorably used, because the large temperature difference between the water and the gas-hydrate zone serves as a heat source for gas decomposition. Gas separation can be further promoted by increasing the temperature of the water by using sunlight or another heat source.

According to the present invention, rapid gas decomposition such as blast jet can be prevented by controlling the difference in pressure between that of the gas-hydrate zone and that at the surface of the earth.

According to the present invention, the process can be widely applied to the extraction of any gas hydrate other than a conventional natural-gas hydrate. Furthermore, the void in the gas-hydrate stratum that results from extraction can be filled and stabilized in both under-land and under-sea areas, where troubles (geohazards) due to removal of the gas hydrate might result. Therefore, troubles (geohazards) due to deformation of the ground can be limited.

EXPLANATION OF THE NUMERALS AND SYMBOLS IN THE DESCRIPTION AND THE DRAWINGS

1. gas-hydrate zone
2. sea floor
2*a* stratum below sea floor
3 high-performance jet fluid
4 gas-hydrate mixed fluid
5 sea surface
6 boring hole
6*a,* 6*b,* 6*c* bent boring holes
10 extraction-pipe control unit
15 extraction-pipe pressure-control unit
20 extracting-fluid supply unit
21 void-refilling fluid
25 gas-extracting device
30 extraction pipe
31 mixed-fluid-recovery pipe
32 high-performance fluid duct
32*a* injection nozzle
33 high-pressure pipe
33*a* high-performance fluid-injection nozzle
100 gas-hydrate extracting device
101 platform

What is claimed is:

1. A gas-hydrate extracting method wherein (a) a high-performance jet fluid is injected from a nozzle at the tip of an extraction pipe that has been inserted into a gas-hydrate stratum, (b) said jet fluid breaks said stratum so as to form a gas-hydrate mixed fluid that is transferred to surface of the earth, and (c) the void resulting from the removal of said gas hydrate is filled with the components of said high-performance jet fluid and a void-refilling fluid.

2. A gas-hydrate extracting method as described in claim 1, wherein said extraction pipe is inserted to the bottom of said gas-hydrate stratum and is slowly retracted upward while being rotated.

3. A gas-hydrate extracting method as described in claim 1, wherein said gas-hydrate mixed fluid is transferred to surface of the earth at a rate controlled by the injection pressure of said high-performance jet fluid, the rotation speed of said injection nozzle, and the speed at which said extraction pipe is retracted upward.

4. A gas-hydrate extracting method as described in claim 1, wherein said gas-hydrate mixed fluid is composed of three phases—air containing gases separated at the gas hydrate zone, water, and solids derived, form the stratum structure—and with said solids being used as the components of said high-performance jet fluid and/or said void—refilling fluid.

5. A gas-hydrate extracting method as described in claim 1, wherein said high-performance jet fluid is composed of air and a super-high-pressure slurry formed by mixing water, fine sand, and viscous clay.

6. A gas-hydrate extracting method as described in claim 5, wherein said super high-pressure slurry is composed of fine granular materials including industrial by-products such as blast-furnace slag, coal ash, and killer instead of said fine sand and viscous clay.

7. A gas-hydrate extracting method as described in claim 5, wherein said fine granular materials include at least on solid selected from blast-furnace slag, coal ash, and cement.

8. A gas-hydrate extracting method as described in claim 1, wherein said extraction pipe has a multiple-pipe structure that is composed of (a) a high-pressure pipe by which said high-performance jet fluid is conveyed to the injection nozzle at the tip of said extraction pipe, (b) a high-performance fluid duct by which said high-performance jet fluid is conveyed to the injection nozzle at the tip, and (c) a fluid-recovery pipe by which said gas-hydrate mixed fluid is transferred to surface of the earth.

9. A gas-hydrate extracting method as described in claim 5, wherein river water and/or spring water on the surface of the ground, or seawater near the surface of the sea, is used as the water of said super-high-pressure slurry.

10. A gas-hydrate extracting method as described in claim 8, wherein said extraction pipe has a control mechanism to control the pressure and the transfer speed of said gas-hydrate mixed fluid.

11. A gas-hydrate extracting device comprising:

an extraction pipe that is composed of (a) a high-pressure pipe by which high-performance jet fluid is conveyed to an injection nozzle at the tip of said extraction pipe, (b) a high-performance fluid duct by which a void-refilling fluid is conveyed to the injection nozzle at said tip of said extraction pipe, and (c) a fluid-recovery pipe by which a gas-hydrate mixed fluid is transferred to surface of the earth, with said extraction pipe being inserted into a boring hole drilled into a gas-hydrate stratum;

an extraction-pipe control unit that controls the rotation speed and the speed of retraction of said extraction pipe;

an extracting-fluid supply unit that supplies a high-pressure fluid, a void-refilling fluid, and high-pressure air;

a pressure-control unit of said extraction pipe;

a gas-extracting device by which gases are recovered from said gas-hydrate mixed fluid.

12. A gas-hydrate extracting method as described in claim 11, wherein said high-performance jet fluid is injected into said gas-hydrate stratum so as to break said stratum, and wherein said void-refilling fluid is injected so as to compensate for the volume of said gas hydrate that has been removed from the stratum.

13. A gas-hydrate extracting method as described in claim 1, wherein said gas hydrate is an ice-like substance including at least methane or butane, and wherein said gas-hydrate stratum is a zone in which said as hydrate is buried in a state that constitutes a dispersion, a mass, a layer or a cluster under the ground or under the sea floor.

* * * * *